US008027608B2

(12) United States Patent
Mukai et al.

(10) Patent No.: US 8,027,608 B2
(45) Date of Patent: Sep. 27, 2011

(54) FIXING DEVICE, IMAGE FORMING APPARATUS EQUIPPED THEREWITH, AND RECORDING MEDIUM ON WHICH TEMPERATURE CONTROL PROGRAM IS RECORDED

(75) Inventors: Takashi Mukai, Osaka (JP); Toshiaki Kagawa, Osaka (JP); Atsuyoshi Nakayama, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 93 days.

(21) Appl. No.: 12/546,926

(22) Filed: Aug. 25, 2009

(65) Prior Publication Data

US 2010/0054788 A1 Mar. 4, 2010

(30) Foreign Application Priority Data

Aug. 27, 2008 (JP) ..... 2008-218855

(51) Int. Cl.
*G03G 15/20* (2006.01)

(52) U.S. Cl. ..... 399/70

(58) Field of Classification Search ..... 399/67, 399/69, 70; 700/300
See application file for complete search history.

(56) References Cited

U.S. PATENT DOCUMENTS

| | | | | |
|---|---|---|---|---|
| 5,701,556 | A * | 12/1997 | Sugimoto | 399/70 |
| 7,254,352 | B2 * | 8/2007 | Lee | 399/69 |
| 7,454,151 | B2 * | 11/2008 | Satoh et al. | 399/69 |
| 2007/0212093 | A1 * | 9/2007 | Maeda et al. | 399/69 |
| 2007/0230982 | A1 * | 10/2007 | Hori et al. | 399/69 |
| 2008/0063419 | A1 * | 3/2008 | Tateishi et al. | 399/70 |
| 2008/0253788 | A1 | 10/2008 | Shinshi | |

FOREIGN PATENT DOCUMENTS

| | | | |
|---|---|---|---|
| JP | 63-173088 | A | 7/1988 |
| JP | 02-034885 | A | 2/1990 |
| JP | 05-224560 | A | 9/1993 |
| JP | 11-024489 | | 1/1999 |
| JP | 2005-202187 | A | 7/2005 |
| JP | 2007-241143 | | 9/2007 |
| JP | 2008-152153 | | 7/2008 |

* cited by examiner

*Primary Examiner* — Sandra Brase

(74) *Attorney, Agent, or Firm* — Renner, Otto, Boisselle & Sklar, LLP

(57) ABSTRACT

A fixing device which can reduce an overshoot of the surface temperature of a main heating section without lengthening a warming-up period of time, an image forming apparatus equipped therewith, and a recording medium on which is recorded the temperature control program are provided. In a standby mode, control is performed to stop an operation of a halogen lamp which is an internal heat source, when a surface temperature of a heating roller reaches a certain temperature lower than a target temperature, or when the operating period of time of the halogen lamp reaches a certain period of time. By so doing, as the heating roller ceases to be heated at a point at which it reaches a temperature lower than the target temperature, it is possible to reduce the overshoot of the surface temperature of the heating roller.

12 Claims, 7 Drawing Sheets

FIXING DEVICE, IMAGE FORMING APPARATUS EQUIPPED THEREWITH, AND RECORDING MEDIUM ON WHICH TEMPERATURE CONTROL PROGRAM IS RECORDED

CROSS-REFERENCE TO RELATED APPLICATION

This application claims priority to Japanese Patent Application No. 2008-218855, which was filed on Aug. 27, 2008, the contents of which are incorporated herein by reference in their entirety.

BACKGROUND OF THE INVENTION

1. Field of the Invention

The present invention relates to a fixing device which fixes a toner image to a recording material under application of heat and pressure, an image forming apparatus equipped therewith, and a recording medium on which is recorded the temperature control program.

2. Description of the Related Art

In an electrophotographic image forming apparatus often employed in a copier, laser printer, facsimile apparatus, or the like, a heat fixing method has thus far been common as a fixing method used in a fixing device. A heating roller fixing method using a heating roller is widely employed in this heat fixing type of fixing device. With the heating roller fixing method, the heating roller, inside which is provided a heater which is a heat source, and whose periphery is covered with rubber or resin having a good demoldability, and a pressure roller, are brought into pressure-contact with each other, transfer paper on which is formed a toner image is caused to pass through a nip region formed between these rollers to heat and fuse toner, and the toner is fused onto a surface of the transfer paper, carrying out a fixing. With the heating roller fixing method, the whole of the heating roller is maintained at a certain temperature, so that it is suitable for an increase in speed of printing.

However, in recent years, a full color image forming apparatus such as a laser printer compatible with a full color printing has often been used, and toners of four colors, magenta, yellow, cyan, and black, have been used in the full color image forming apparatus. In the full color image forming apparatus, as there is a need to mix a plurality of kinds of color toner in a condition close to fusion in order to fix a full color toner image, unlike a case of a single color toner fixing in which toner is simply fixed while being softened and pressurized, it is necessary in the fixing device to place toner in a condition in which it is completely fused.

For this reason, with the heating roller fixing type of fixing device in the full color image forming apparatus, an elastic body which is a rubber layer formed of silicone rubber or the like is provided on a support made of a metal or the like with an excellent thermal conductivity, and a surface of the elastic body is covered with a fluorine resin having a good demoldability, forming a heating roller.

However, in the heating roller fixing type of fixing device using this kind of heating roller too, when the image forming apparatus starts to operate, it is necessary to heat the rubber layer with a low thermal conductivity by means of a heat source such as a heater provided inside the heating roller until a predetermined temperature is reached. For this reason, there is a problem in that period of time (a warming-up period of time) needed from the image forming apparatus being powered on until it is operable is lengthened, causing a waiting period of time. Also, there is also a problem in that the temperature of the heating roller decreases at the time of a continuous operation at a high speed.

Thus, in recent years, in order to solve these problems, a fixing device has been proposed wherein, by bringing a belt type external heating section, equipped with a heating belt which rotates while being heated, into abutment with the surface of a heating roller, the heating roller is heated not only from a heater inside it, but also from the external surface (refer to, for example, Japanese Unexamined Patent Publication JP-A 2007-241143 and Japanese Unexamined Patent Publication JP-A 11-24489 (1999)).

As a method of reducing the warming-up period of time in the external heating fixing type of fixing device, the kind of control shown below is described in JP-A 2007-241143.

Heat sources 74 and 75 of external heating members of the fixing device, to be described hereafter in reference to FIG. 4, are powered on. A rotation of a motor is started after the external heating members are heated as far as a first temperature T1. In the event that a belt type external heating member is used as the external heating members, when an external heating belt is at a low temperature, the belt is impressed, and does not rotate easily. For this reason, the motor is rotated after the temperature of the belt is increased to the temperature T1 at which the belt is sufficiently softened. In order to effectively heat the surface of the heating roller, the heat sources 74 and 75 of the external heating members continue to be powered on after the rotation of the motor too. After the belt is heated as far as T3, which is a belt target temperature, an electric power ON/OFF control is carried out so as to maintain the temperature of the belt at T3. When the heat sources of the external heating members are powered off, electric power is switched and applied to a heat source 54 of the heating roller. By repeating this control, the heating roller continues to be heated to its target temperature.

Also, in JP-A 11-24489, there is proposed a fixing device which can maintain a good fixing performance by adjusting the lighting timings of heating sources provided one inside each of a heating fixing member and an external heating member so that the individual heating sources are not lighted at the same time, and by most efficiently using the heating fixing member and external heating member within a limited range of electric power.

Generally, in a case of carrying out the warming-up control described in JP-A 2007-241143, after the external heating members reach the target temperature T3, the external heating members are ON/OFF controlled by the control method shown in FIG. 7 so that they are maintained at T3 and, in the event that a feed of electric power to the external heating members is cut off, electric power is fed to the heat source inside the heating roller in order to efficiently heat the heating roller, and the heating roller is heated from inside. In this case, in order to reduce the warming-up period of time, it is necessary to make electric power high for a lamp inside the heating roller.

Also, normally, in a standby mode, a control of the temperature of the heating roller is carried out by the kind of method shown in the flowchart of FIG. 7, to be described hereafter, (refer to JP-A 11-24489).

It is determined in step S11 whether or not the surface temperature of the heating roller is equal to or less than a predetermined temperature Ta, which is lower than the target temperature and, if it is Ta or less, in step S12, electric power is fed to a halogen lamp. If it is higher than Ta, the process waits.

It is determined in step S13 whether or not the surface temperature of the heating roller has reached Tb, which is the target temperature and, if Tb is reached, in step S14, the feed of electric power to the halogen lamps is stopped. If Tb is not reached, the process returns to step S12, and the heating by the halogen lamp is continued.

However, in the event of making electric power high for the lamp inside the heating roller, when the surface temperature of the heating roller has reached the target temperature, and the feed of electric power to the heat source is cut off, the temperature of the metal core of the heating roller is considerably high. This is a difference in temperature caused by the thermal conductivity of the elastic layer of the heating roller being low. The difference in temperature appears more prominently as the thickness of the elastic layer increases. For this reason, a phenomenon called an overshoot occurs wherein the heat of the metal core is transmitted to the surface of the elastic layer, delayed, even after the feed of electric power to the heater inside the heating roller is cut off, and the surface temperature of the heating roller increases by about 20° C. eventually. Also, by the temperature of the metal core becoming higher, the elastic body in contact with the metal core is exposed to a high temperature, causing a thermal deterioration.

Also, particularly, in a case of shifting from the warming-up operation to the standby mode, the overshoot of the surface temperature of the heating roller is large, and the temperature of the metal core is also at its highest. After the heating roller is idled for a predetermined period of time from a finishing of the warming-up operation, an operational mode switches to the standby mode, stopping the rotation of the drive motor of the heating roller. As the inside of the heating roller is not sufficiently heated at this time, a decrease in temperature of the heating roller occurs at a point at which the heat from the external heating member ceases to be supplied. Thus, electric power is fed to the heat source of the heating roller, carrying out the heating but, as previously described, when a high-power heat source is disposed in order to reduce the warming-up time, in the event that the heating roller is heated by the heat source, causing the surface temperature of the heating roller to reach the target temperature, the metal core portion reaches a considerably high temperature due to a difference in thermal conductivity. Also, period of time needed for feeding electric power to the heat source is lengthened. For this reason, the elastic body in contact with the metal core is exposed to a high temperature, causing the thermal deterioration.

Furthermore, in recent years, a stress on the heating roller has increased because a control reducing a standby mode period of time is used in order to contribute to an energy conservation, and the number of increases in temperature from a low temperature to an operating temperature in one day increases, causing the overshoot of the heating roller, and exposing the elastic body to a high temperature of the metal core.

As a method of suppressing the overshoot and the thermal deterioration of the elastic body, there is a method of reducing the output of the heater lamp inside the heating roller, reducing the output of the heater lamp inside the heating roller at a waiting period of time by means of a phase control, or the like. However, in the event of reducing the output of the heater lamp inside the heating roller, a negative effect, such as an increase in the warming-up period of time, or a decrease in the amount of heat supplied at a mass printing period of time, occurs. Also, it is also possible to reduce the output of the heater lamp by using the phase control, but not only is a ratio of reducing the output limited, but efficiency also decreases. Also, there is a negative effect such that the life of the heater lamp is reduced.

SUMMARY OF THE INVENTION

An object of the invention is to provide a fixing device which can reduce overshoot of the surface temperature of a main heating section without lengthening a warming-up period of time, an image forming apparatus provided therewith, and a recording medium on which is recorded the temperature control program.

The invention provides a fixing device comprising:

a main heating section adapted to be able to rotate around an axis thereof, and heating a recording material bearing an unfixed toner image by a heat source provided therein to fuse toner of the unfixed toner image;

a pressure section disposed so as to form a pressure-contact region between the pressure section and the main heating section by coming into pressure-contact with the main heating section, the pressure section pressing, in cooperation with the main heating section, that recording material bearing the unfixed toner image which is fed at the pressure-contact region, and fixing a toner image on the recording material; and an external heating section disposed so as to come into contact with an outer peripheral surface of the main heating section or pressure section from an exterior thereof, the external heating section heating the main heating section or the pressure section, wherein in a standby mode in which the temperature of the main heating section is held up after the main heating section is heated by a predetermined temperature, heating control is performed, after starting the operation of the heat source, to stop the operation of the heat source, when the temperature of the surface of the main heating section reaches a certain temperature lower than a target temperature, or when the operation period of time of the heat source reaches a certain period of time.

According to the invention, in a standby mode in which the main heating section is heated by a predetermined temperature by means of the external heating section, heating control is performed to stop the operation of the heat source, when the temperature of the surface of the main heating section reaches a certain temperature lower than a target temperature, or when the operation period of time of the heat source reaches a certain period of time.

By this means, as the main heating section ceases to be heated at a point at which the main heating section is at a temperature lower than the target temperature, even in the event of using a high output heat source in order to reduce a warming-up period of time, it is possible to reduce an overshoot of the surface temperature of the main heating section.

Also, the invention provides a fixing device comprising:

a main heating section adapted to be able to rotate around an axis thereof, and heating a recording material bearing an unfixed toner image by a heat source provided therein to fuse toner of the unfixed toner image;

a pressure section disposed so as to form a pressure-contact region between the pressure section and the main heating section by coming into pressure-contact with the main heating section, the pressure section pressing, in cooperation with the main heating section, that recording material bearing the unfixed toner image which is fed at the pressure-contact region, and fixing a toner image on the recording material; and an external heating section disposed so as to come into contact with an outer peripheral surface of the main heating section or pressure section from an exterior thereof, the external heating section heating the main heating section or the pressure section, wherein in a standby mode in which the temperature of the main heating section is held up after the main heating section is heated by a predetermined temperature, heating control is performed, after starting the operation of the heat source, to stop the operation of the heat source, when the temperature of the surface of the main heating section reaches a certain temperature lower than a target temperature, or when the operation period of time of the heat source reaches a certain period of time, and continue to do so for a given length of time.

According to the invention, in a standby mode in which the main heating section is heated by a predetermined temperature by means of the external heating section, heating control is performed to stop the operation of the heat source, when the temperature of the surface of the main heating section reaches a certain temperature lower than a target temperature, or when the operation period of time of the heat source reaches a certain period of time, and continue to do so for a given length of time.

By this means, as the main heating section ceases to be heated at a point at which the main heating section is at a temperature lower than the target temperature, even in the event of using a high output heat source in order to reduce the warming-up period of time, it is possible to reduce the overshoot of the surface temperature of the main heating section.

Furthermore, it is possible to prevent the operation of the heat source from being started due to a delay in transmission of heat generated by the heat source to the surface of the main heating section, and the surface temperature of the main heating section from increasing to excess.

Also, in the invention, it is preferable that in an operational mode other than the standby mode, the heating control is not carried out.

According to the invention, as the heating control is not carried out in an operational mode other than the standby mode, it is possible to prevent the warming-up period of time and a printing period of time from being affected.

Also, in the invention, it is preferable that the heating section is formed with a roller member comprising a metal core, an elastic body layer, and a surface layer, and in the heating control, the operation of the heat source is controlled so that the temperature of the metal core is 240° C. or less.

According to the invention, in the heating control, the operation of the heat source is controlled so that the temperature of the metal core included in the heating section is 240° C. or less.

By this means, it is possible to prevent a thermal deterioration of the elastic body layer in contact with the metal core.

Also, the invention provides an image forming apparatus provided with the fixing device mentioned above.

According to the invention, by providing an image forming apparatus with the fixing device, it is possible to make the image forming apparatus have a longer life and no poor fixing.

Also, the invention may provide a computer readable recording medium on which is recorded a temperature control program for causing a computer to perform the heating control in the fixing device mentioned above.

According to the invention, it is possible to provide a computer readable recording medium on which is recorded temperature control program for causing a computer to perform the heating control in the fixing device mentioned above.

BRIEF DESCRIPTION OF DRAWINGS

Other and further objects, features, and advantages of the invention will be more explicit from the following detailed description taken with reference to the drawings wherein.

DETAILED DESCRIPTION

Figure 1:
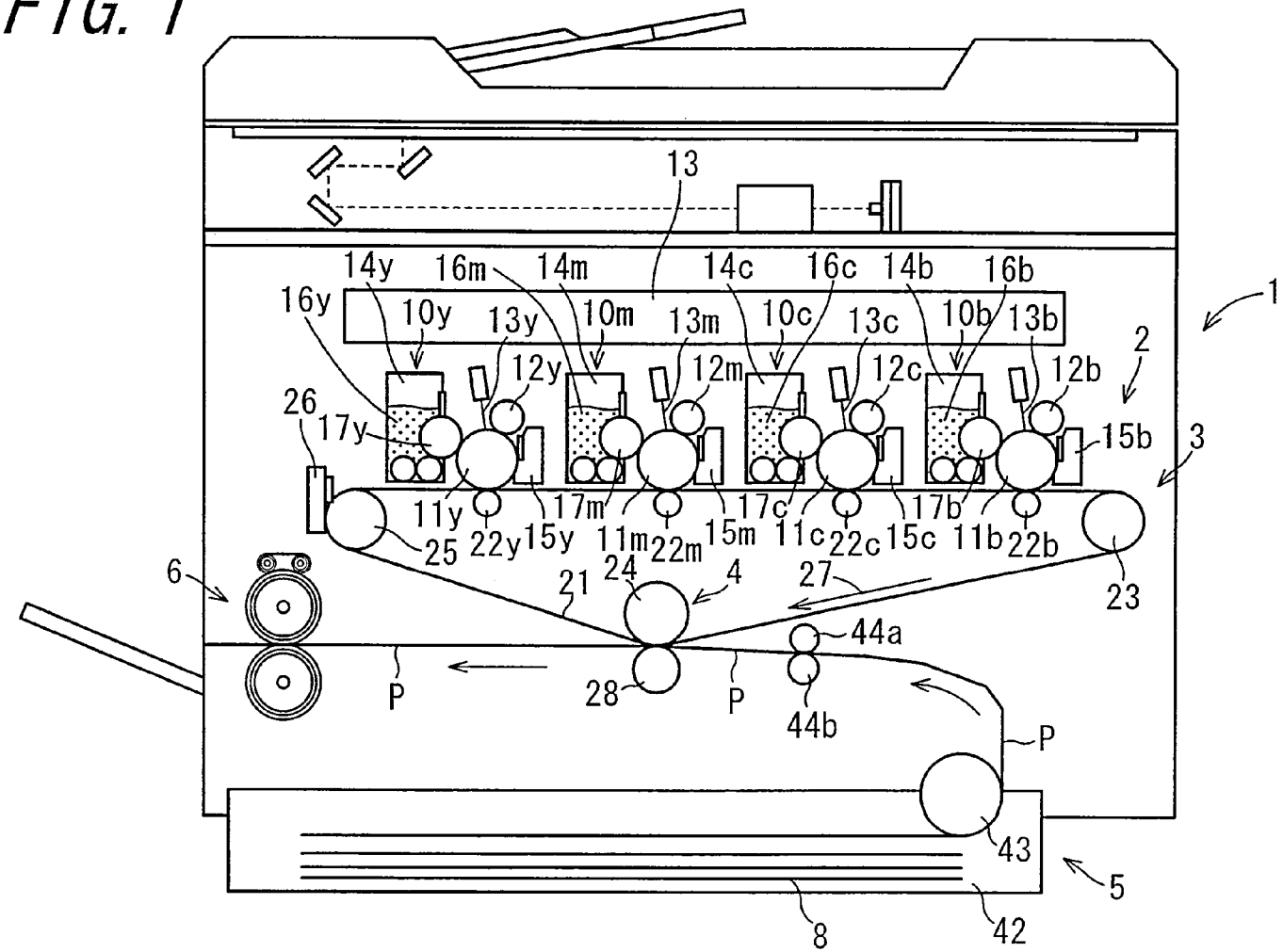
FIG. 1 is a schematic diagram showing a configuration of an image forming apparatus.

Now referring to the drawings, preferred embodiments of the invention are described below.

Hereafter, a description will be given, referring to the drawings, of an image forming apparatus 1 according to an embodiment of the invention.

Figure 2:
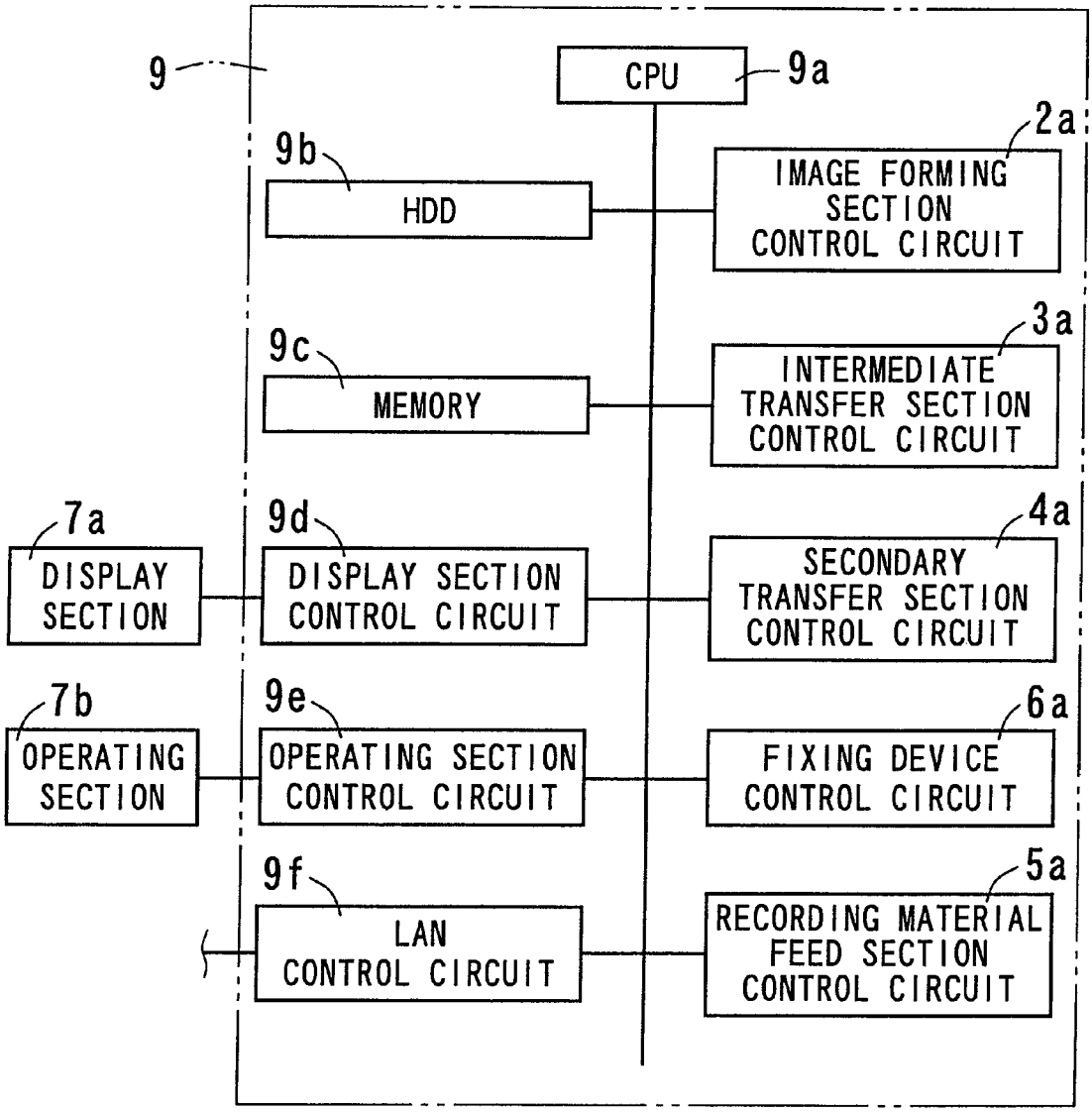
FIG. 2 is a block diagram showing a configuration of a control section of the image forming apparatus.

FIG. 1 is a schematic diagram showing a configuration of the image forming apparatus 1. FIG. 2 is a block diagram showing a configuration of a control section 9 of the image forming apparatus 1. In FIG. 1, the image forming apparatus 1 is configured of an image forming section 2, an intermediate transfer section 3, a secondary transfer section 4, a recording material feed section 5, and a fixing device 6.

Also, as shown in FIG. 2, the image forming apparatus 1 is equipped with, apart from each above-described section and the like, a display section 7*a* formed of a liquid crystal display (LCD), an operating section 7*b* including various kinds of keys, and the control section 9 controlling each above-described section and the like.

In FIG. 2, the control section 9 is configured of a central processing unit (CPU) 9*a*, a hard disc drive (HDD) 9*b*, a memory 9*c*, a display section control circuit 9*d*, an operating section control circuit 9*e*, a local area network (LAN) control circuit 9*f*, an image forming section control circuit 2*a*, an intermediate transfer section control circuit 3*a*, a secondary transfer section control circuit 4*a*, a recording material feed section control circuit 5*a*, and a fixing device control circuit 6*a*.

As well as the CPU 9*a* being configured of a microprocessor, software such as an operating system (OS) and various kinds of control program and application program, to be used for controlling the image forming apparatus 1, is stored in the HDD 9*b*, and the CPU 9*a*, based on the software, carries out various kinds of control and process.

Also, the display section control circuit 9*d* is used to carry out an operational control of the display section 7*a*, the operating section control circuit 9*e* of the operating section 7*b*, the LAN control circuit 9*f* of a LAN interface, the image forming section control circuit 2*a* of the image forming section 2, the intermediate transfer control circuit 3*a* of the intermediate transfer section 3, the secondary transfer section control circuit 4*a* of the secondary transfer section 4, the fixing device control circuit 6*a* of the fixing device 6, and the recording material feed section control circuit 5*a* of the recording material feed section 5.

Hereafter, a description will be given of each above-described section. Firstly, a description will be given of the recording material feed section 5. The recording material feed section 5 is configured of a recording paper storage tray 42 which stores recording paper 8 which is a recording material, a recording paper discharge roller 43 which discharges the recording paper 8 stored in the recording paper storage tray 42, conveyance rollers 44*a* and 44*b* which convey the discharged recording paper 8 to the secondary transfer section 4, and a conveyance path P.

Next, a description of an image forming section 2 will be given. As shown in FIG. 1, the image forming section 2 includes image forming units 10*y*, 10*m*, 10*c*, and 10*b* which form electrostatic latent images which correspond to digital signals (hereinafter described as image information) of the respective colors, develop the latent images and form the toner images with toner of each color. That is, the image forming unit 10*y* forms a toner image corresponding to yellow image information. The image forming unit 10*m* forms a toner image corresponding to magenta image information. The image forming unit 10*c* forms a toner image corresponding to cyan image information. The image forming unit 10*b* forms a toner image corresponding to black image information.

As the image forming units 10*y*, 10*m*, 10*c*, and 10*b* are of the same configuration except that a yellow developer, magenta developer, cyan developer, and black developer are used in the respective image forming units, and that, among pieces of image information inputted into the image forming section 2, a pixel signal corresponding to a yellow component image, a pixel signal corresponding to a magenta component image, a pixel signal corresponding to a cyan component image, and a pixel signal corresponding to a black component image are inputted into the respective image forming units, hereafter, the image forming unit 10*y* for yellow will be shown as a representative example, and a description of the others will be omitted.

The image forming units 10 and the like for the individual colors, when separately shown, will be represented with alphabetical suffixes: y (yellow), m (magenta), c (cyan), and b (black), affixed thereto. The image forming units 10*y*, 10*m*, 10*c*, and 10*b* are arranged into a line in the order named, from an upstream side to a downstream side, in a direction of movement (a sub-scanning direction) of an intermediate transfer belt 21 which is an intermediate transfer medium, that is, in the direction of an arrow 27.

Figure 3:
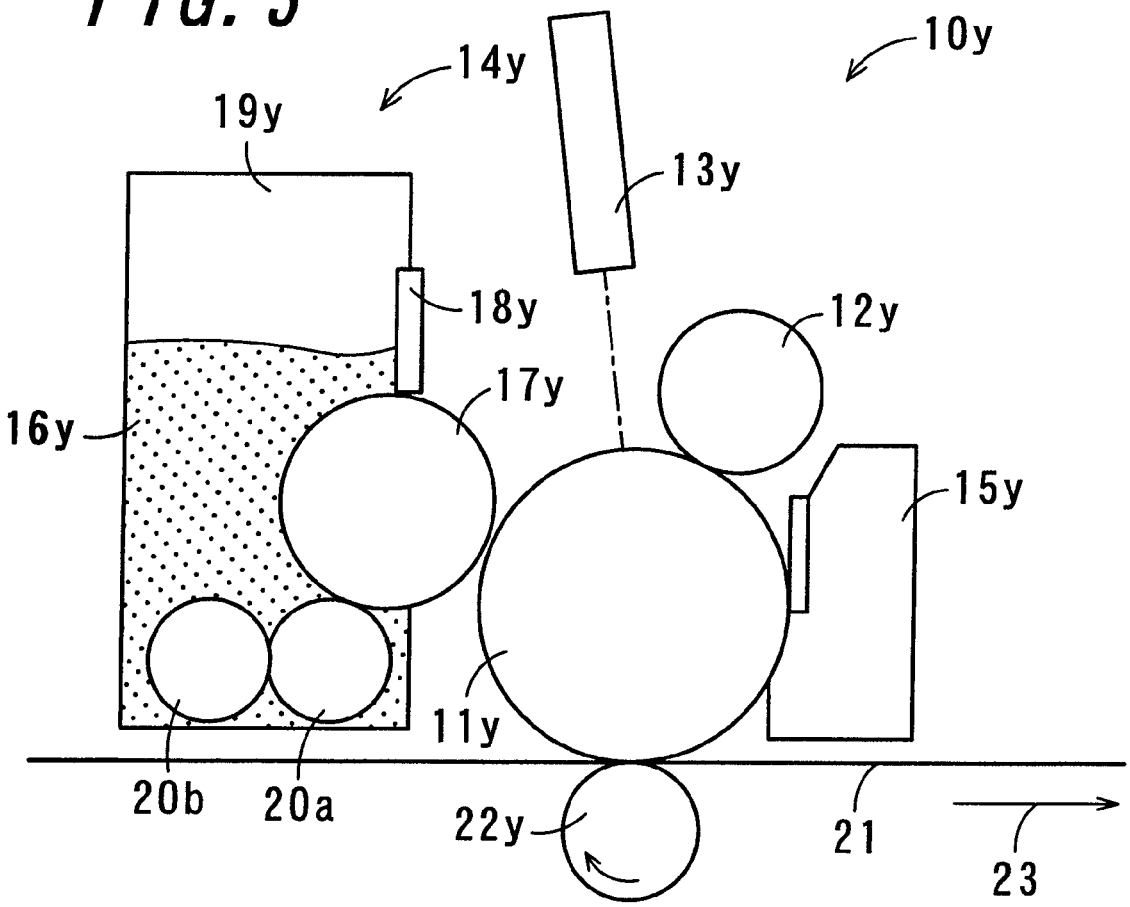
FIG. 3 is a schematic diagram showing a configuration of an image forming unit.

FIG. 3 is a schematic diagram showing a configuration of the image forming unit 10*y*. As shown in FIG. 3, the image forming unit 10*y* includes a photoreceptor drum 11*y*, on the surface of which a yellow toner image is formed, a charging roller 12*y*, which uniformly charges the surface of the photoreceptor drum 11*y*, an optical scanning unit 13*y*, which exposes the charged surface of the photoreceptor drum 11*y* to light corresponding to the image information, forming an electrostatic latent image, a developing device 14*y*, which forms a toner image by attaching toner to the electrostatic latent image formed on the surface of the photoreceptor drum 11*y*, and a drum cleaner 15*y*, which removes and collects toner remaining on the surface of the photoreceptor drum 11*y* without being intermediately transferred to the intermediate transfer belt 21.

The photoreceptor drum 11*y* is a latent image bearing member which, by being exposed to the light corresponding to the image information, has an electrostatic latent image formed on the surface thereof, and is provided so as to be rotatable. The photoreceptor drum 11*y*, being supported so as to be able to be rotationally driven around its axis by a driving portion (not shown), includes a cylindrical, columnar, or thin film sheet-like (preferably, cylindrical) conductive substrate (not shown) and a photosensitive layer (not shown) formed on the surface of the conductive substrate.

As the photoreceptor drum 11*y*, it is possible to use one commonly used in this field, and it is possible to propose, for example, a photoreceptor drum 11*y* which, being connected to a ground (GND) potential, includes an aluminum base tube which is the conductive substrate, and an organic photosensitive layer which is the photosensitive layer formed on the surface of the aluminum base tube.

The organic photosensitive layer may be one formed laminating a charge generating layer including a charge generating substance, and a charge transporting layer including a charge transporting substance, or may be one having the charge generating substance and charge transporting substance included in one layer. The thickness of the organic photosensitive layer is not particularly limited but is, for example, 20 μm. Also, an undercoat layer between the organic layer and conductive substrate may be provided. Furthermore, a protecting layer may be provided on the surface of the organic photosensitive layer.

The photoreceptor drum 11*y* rotates at a circumferential speed of, for example, 220 mm/s in a counterclockwise direction as seen facing the plane of FIG. 3. The driving portion of the photoreceptor drum 11*y* is controlled by the image forming section control circuit 2*a*, thereby controlling the rotation speed of the photoreceptor drum 11*y*.

The charging roller 12*y* is a charging section which charges the surface of the photoreceptor drum 11*y* with potential of predetermined polarity. As the charging section, it is not limited to only the charging roller 12*y* and the charging roller 12*y* can be replaced by a brush-type charging device, a charger-type charging device, or a corona charging device such as a scorotron charger.

The optical scanning unit 13*y* is a latent image forming section which irradiates the charged surface of the photoreceptor drum 11*y* with a laser beam corresponding to the yellow image information, and forms an electrostatic latent image corresponding to the yellow image information on the surface of the photoreceptor drum 11*y*. A semiconductor laser element or the like is used as a laser beam light source.

The developing device 14*y* is a developing section which, being provided facing the photoreceptor drum 11*y*, limits a yellow developer 16*y* including a yellow toner and a carrier to a predetermined amount by means of a layer thickness limitation member 18*y*, bears it on the surface of a developing sleeve 17*y*, conveys it to the surface of the photoreceptor drum 11*y*, and develops and visualizes the electrostatic latent image formed on the surface of the photoreceptor drum 11*y*. As the developing device 14*y*, it is also possible to use one using a one-component developer including no carrier, or the like.

The developing sleeve 17*y* is rotationally driven in the same direction as a direction of rotational drive of the photoreceptor drum 11*y*, in a developing nip region which is close to the photoreceptor drum 11*y*. Consequently, a direction of rotational drive around the axis of the developing sleeve 17*y* is opposite to the direction of rotational drive of the photoreceptor drum 11*y*.

The drum cleaner 15*y* removes and collects a yellow toner remaining on the surface of the photoreceptor drum 11*y* after the yellow toner image on the surface of the photoreceptor drum 11*y* is intermediately transferred to the intermediate transfer belt 21.

Hereafter, a detailed description will be given of a component of the developers 16*y*, 16*m*, 16*c*, and 16*b* used in the image forming apparatus 1 of the embodiment.

Hereafter, a description will be given of a one-component developer configured of toner for the developers 16*y*, 16*m*, 16*c*, and 16*b*.

The toner comprises toner particles each containing a binder resin, a colorant, and a release agent. As the binder resin, ingredients customarily used in this field can be used, and examples thereof include polystyrene, a homopolymer of styrene substitute, a styrene-type copolymer, polyvinyl chloride, polyvinyl acetate, polyethylene, polypropylene, polyester, and polyurethane. The binder resins may be used each alone, or two or more thereof may be used in combination.

Among the above kinds of binder resin, for the color toner, preferable is the binder resin which has a softening temperature of 100° C. to 150° C. and a glass transition temperature of 50° C. to 80° C., and particularly preferable is polyester which has a softening temperature and a glass transition temperature in the above ranges, from the aspect of storage stability, durability, etc. Polyester in a softened or fused state is high in transparency. In the case where polyester is used as the binder resin, when a multicolor toner image composed of combined toner images of yellow, magenta, cyan, and black, is fixed on a recording sheet 8, the polyester itself becomes transparent, leading to sufficient color development by subtractive color mixture.

As the colorant, it is possible to use pigments and dyes for toner which have been conventionally used in the electrophotographic image forming technique. Examples of the pigment include an organic pigment such as azo pigment, benzimidazolone pigment, quinacridone pigment, phthalocyanine pigment, isoindolinone pigment, isoindoline pigment, dioxazine pigment, anthraquinone pigment, perylene pigment, perynone pigment, thioindigo pigment, quinophthalone pigment, or metal complex pigment; an inorganic pigment such as carbon black, titanium oxide, molybdenum red, chrome yellow, titanium yellow, chrome oxide, or Berlin blue; and metal powder such as aluminum powder. The pigments may be used each alone, or two or more thereof may be used in combination.

As the release agent, wax can be used, for example. It is possible to use the wax which is customarily used in this field, and examples thereof include polyethylene wax, polypropylene wax, and paraffin wax. The toner may contain, other than the binder resin, colorant, and release agent, one or two or more additives for general use in toner, such as a charge control agent, a fluidity improving agent, a fixing promoting agent, and a conductive agent.

The toner can be manufactured according to the above known methods such as a pulverization method, a suspension polymerization method, and an emulsification coagulation method. In the pulverizing method, the colorant, the release agent, etc. are melt-kneaded together with the binder resin, followed by pulverization. In the suspension polymerization method, the colorant, the release agent, a monomer of the binder resin, etc. are evenly dispersed, followed by polymerization of the monomer of the binder resin. In the emulsification coagulation method, binder resin particles, the colorant, the release agent, etc., are coagulated with the aid of a coagulant, and fine particles of a thus-obtained coagulated product are heated.

The volume average particle size of the toner is not particularly limited, but is preferably 2 to 7 μm. Also, in the event that the volume average particle size of the toner is appropriately small in this way, as the fraction of coverage of the recording material is high, it is possible to achieve an increase in image quality with a small amount of toner attached, and a decrease in toner consumption.

When the volume average particle size of the toner is less than 2 μm, the toner may be degraded in fluidity, leading to insufficient supply, stirring, and charging of the toner upon the developing operation. This may cause a shortage of the toner amount, an increase of toner of reverse polarity, and the like problem, which possibly leads to a failure in forming high-quality images. When the volume average particle size of the toner exceeds 7 μm, a larger amount of the toner particles has such a large size that a center part of each toner particle is hard to be soften, with the result that a fixing property of the image onto the recording sheet 8 is degraded and moreover, the color development of the image is lower. And particularly in the case of fixing the image onto an OHP sheet, an obtained image is darker.

The toner of respective colors used in the embodiment, except the colorant has the same configuration as follows. The toner is, for example, a negatively-charged nonmagnetic insulating toner which has a glass transition temperature of 60° C., a softening temperature of 120° C., and a volume average particle size of 6 μm. When using the toner to obtain an image having an image density of 1.4 measured through a reflection densitometer type 310 manufactured by X-Rite Incorporated, a required toner amount is 5 g/m$^2$. The toner contains polyester having a glass transition temperature of 60° C. and a softening temperature of 120° C. as the binder resin, a low-molecular polyethylene wax having a glass transition temperature of 50° C. and a softening temperature of 70° C. as the release agent, and pigments of respective colors as colorant. A content of the wax is 7% by weight of the total amount of the toner while a content of the pigment is 12% by weight of the total amount of the toner, with the binder resin, i.e., polyester which occupies a remaining part of the total amount of the toner. The low-molecular polyethylene wax contained in the toner is wax whose glass transition temperature and softening temperature are lower than those of the polyester serving as the binder resin.

The developers 16*y*, 16*m*, 16*c*, and 16*b* may be a two-component developer including a carrier in addition to the toner. As the carrier, it is possible to use magnetic particles. As a specific example of the magnetic particles, it is possible to propose, for example, a metal such as iron, ferrite, or magnetite, or an alloy of these metals and a metal such as aluminum or lead. Among them, ferrite is preferable.

A resin coated carrier having magnetic particles coated with a resin, a resin dispersion type carrier having magnetic particles dispersed on a resin, or the like, may be used as the carrier. As the resin coating the magnetic particles, although it is not particularly limited, examples thereof include an olefin resin, styrene resin, styrene/acrylic resin, silicone resin, ester resin, and fluorine-containing polymer resin. Also, also as the resin used in the resin dispersion type carrier, although it is not particularly limited, examples thereof include a styrene acrylic resin, polyester resin, fluorine resin, and phenol resin.

It is preferable that the shape of the carrier is a spherical or flat shape. Also, the volume average particle size of the carrier is not particularly limited but, considering the increase in image quality, is preferably 30 μm or more to 50 μm or less. Furthermore, the resistivity of the carrier is preferably $10^8\Omega\cdot$cm or more, and more preferably, $10^{12}\Omega\cdot$cm or more. The resistivity of the carrier is a value obtained by reading a current value when, after putting the carrier in a container having a cross-sectional area of 0.50 cm$^2$, and tapping it, applying a load of 1 kg/cm$^2$ to particles filling the container, and applying a voltage which causes an electric field of 1000 V/cm between the load and a bottom electrode. When the resistivity is low, an electrical charge is injected into the carrier in the event that a bias voltage is applied to the developing sleeves 17*y*, 17*m*, 17*c*, and 17*b*, and carrier particles are likely to adhere to the photoreceptor drum. Also, a breakdown of the bias voltage is likely to occur.

The magnetization intensity (maximum magnetization) of the carrier is preferably 10 emu/g to 60 emu/g, and more preferably, 15 emu/g to 40 emu/g. Although the magnetization intensity depends on the magnetic flux density of the developing sleeves 17*y*, 17*m*, 17*c*, and 17*b*, under conditions of the general magnetic flux density of the developing sleeves 17*y*, 17*m*, 17*c*, and 17*b*, there is a fear that no magnetic constraint force acts in the event of less than 10 emu/g, causing a carrier dispersion. Also, when the magnetization intensity exceeds 60 emu/g, with a non-contact development in which a magnetic brush of the carrier is too high, it is difficult to keep a non-contact condition with the photoreceptor drum which is the latent image bearing member. Also, with a contact development, there is a fear that a brush mark is likely to appear in the toner image.

A ratio of toner and carrier used in the developers 16*y*, 16*m*, 16*c*, and 16*b* is not particularly limited, and it is sufficient to appropriately select it depending on the type of toner and carrier.

According to the image forming unit 10*y*, for example, 1200 V is applied to the charging roller 12*y* by a power source (not shown) while rotationally driving the photoreceptor drum 11*y* around its axis, and the photoreceptor drum 11*y* is discharged, thereby charging the surface of the photoreceptor drum 11*y* to, for example, 600 V. Next, the charged surface of the photoreceptor drum 11*y* is irradiated with the laser beam corresponding to the yellow image information from the optical scanning unit 13*y*, forming an electrostatic latent image with an exposure potential of −70 V corresponding to the yellow image information.

Next, the surface of the photoreceptor drum 11*y* and the yellow developer borne on the surface of the developing sleeve 17*y* are brought into proximity with one another. A direct current voltage of −450 V is applied to the developing sleeve 17*y* as a development potential, and the yellow toner adheres to the electrostatic latent image due to a difference in potential between the developing sleeve 17*y* and the photoreceptor drum 11*y*, forming the yellow toner image on the surface of the photoreceptor drum 11*y*. As will be described hereafter, the yellow toner image is brought into pressure-contact with the surface of the photoreceptor drum 11*y*, and intermediately transferred to the intermediate transfer belt 21 driven in the direction of the arrow 27. A yellow toner remaining on the surface of the photoreceptor drum 11*y* is removed and collected by the drum cleaner 15*y*. Hereafter, a yellow toner image forming operation will be repeatedly executed in the same way.

Next, a description will be given of the intermediate transfer section 3. As shown in FIG. 1, the intermediate transfer section 3 includes the intermediate transfer belt 21, intermediate transfer rollers 22*y*, 22*m*, 22*c*, and 22*b*, supporting rollers 23, 24, and 25, and a belt cleaner 26. The intermediate transfer belt 21 is an endless belt shaped image bearing member which is supported around the supporting rollers 23, 24, and 25 with tension to thereby form a loop-like travel path, and is rotationally driven in the direction of the arrow 27 at approximately the same circumferential speed as that of the photoreceptor drums 11*y*, 11*m*, 11*c*, and 11*b*, that is, so that an image bearing surface facing the photoreceptor drums 11*y*, 11*m*, 11*c*, and 11*b* moves from the photoreceptor drum 11*y* toward the photoreceptor drum 11*b*.

As the intermediate transfer belt 21, it is possible to use, for example, a 100 μm thick polyimide film. As a material of the intermediate transfer belt 21, it not being limited to polyimide, it is possible to use a film configured of a synthetic resin, such as polycarbonate, polyamide, polyester, or polypropylene, various kinds of rubber, or the like. The film made of a synthetic resin or any kind of rubber contains an electrically conductive material, such as furnace black, thermal black, channel black, or graphite carbon, in order to adjust an electric resistance value with which it acts as the intermediate transfer belt 21. Also, a covering layer configured of a fluorine resin composition, fluorine-containing rubber, or the like, which has a low adhesion to toner, may be provided on the intermediate transfer belt 21. As a component material of the covering layer, examples thereof include polytetrafluoroethylene (PTFE) and PFA (a copolymer of PTFE and perfluoroalkyl vinyl ether). The covering layer may contain an electrically conductive material.

A toner image bearing surface of the intermediate transfer belt 21 comes into pressure-contact with the photoreceptor drums 11*y*, 11*m*, 11*c*, and 11*b* in the order just stated from the upstream side in the rotational direction of the intermediate transfer belt 21. Positions where the intermediate transfer belt 21 comes into pressure-contact with the photoreceptor drums 11*y*, 11*m*, 11*c*, and 11*b*, are positions where toner images of respective colors are transferred.

The intermediate transfer rollers 22*y*, 22*m*, 22*c*, and 22*b* are roller members which are respectively opposed to the photoreceptor drums 11*y*, 11*m*, 11*c*, and 11*b* with the intermediate transfer belt 21 interposed therebetween and come into pressure-contact with a reverse side of the toner image bearing surface 21*a* of the intermediate transfer belt 21 and which are disposed so as to be rotationally driven about respective axial line of the rollers by a driving portion (not shown).

For each of the intermediate transfer rollers 22*y*, 22*m*, 22*c*, and 22*b*, a roller member is used, for example, which is composed of a metallic shaft and a conductive layer covering a surface of the metallic shaft. The metallic shaft is, for example, formed of a metal such as stainless steel. A diameter of the metallic shaft is not particularly limited, and preferably from 8 mm to 10 mm. The conductive layer is formed of a conductive elastic body or the like material. As the conductive elastic body, a material customarily used in this field is applicable, and examples thereof include ethylene-propylene rubber (hereinafter described as EPDM), foamed EPDM, and urethane foam, which contain a conductive material such as carbon black. Owing to the conductive layer, high voltage is evenly applied to the intermediate transfer belt 21.

Owing to the conductive layer, high voltage is evenly applied to the intermediate transfer belt 21. Since the toner images formed on the surfaces of the photoreceptor drum 11*y*, 11*m*, 11*c*, and 11*b* are transferred onto the intermediate transfer belt 21, intermediate transfer bias voltage is applied to the intermediate transfer rollers 22*y*, 22*m*, 22*c*, and 22*b* through a constant voltage control, which bias has a polarity reverse to that of the polarity of the charged toner. By so doing, the toner images of yellow, magenta, cyan, and black formed on the photoreceptor drums 11*y*, 11*m*, 11*c*, and 11*b* are sequentially transferred and overlaid on top of one another on the toner image bearing surface of the intermediate transfer belt 21, thus forming a multicolor toner image. Note that in the case where image information of only part of yellow, magenta, cyan, and black is inputted, a toner image is formed by only an image forming unit 10 corresponding to a color of inputted image information, among the image forming units 10*y*, 10*m*, 10*c*, and 10*b*.

Among the supporting rollers 23, 24, and 25, the supporting rollers 23, and 25 are disposed so as to be rotationally driven about respective axes thereof by a driving portion (not shown), support the intermediate transfer belt 21 therearound with tension and rotated in the direction of the arrow 27 by the supporting rollers 23, 24, and 25. For each of the supporting rollers 23, 24, and 25, an aluminum-made cylinder (a pipe-shaped roller) is used, for example, having a diameter of 30 mm and a thickness of 1 mm. The supporting roller 24 comes into pressure-contact with a later-described secondary transfer roller 28 with the intermediate transfer belt 21 interposed therebetween, thus forming a secondary transfer nip region, and is electrically grounded. Among them, the supporting roller 24 has a function of support the intermediate transfer belt 21 therearound with tension together with a function of secondarily transferring the toner image on the intermediate transfer belt 21 onto the recording sheet 8.

The belt cleaner 26 is a member for removing the toner which remains on the image bearing surface after the toner image on the bearing surface of the intermediate transfer belt 21 is transferred onto the recording sheet 8 in the later-described secondary transfer section 4. The belt cleaner 26 is disposed opposite to the supporting roller 25 with the intermediate transfer belt 21 interposed therebetween.

According to the intermediate transfer section 3, the toner images formed on the photoreceptor drums 11*y*, 11*m*, 11*c*, and 11*b*, by a high voltage with a polarity, the reverse of a toner charging polarity, being uniformly applied to the intermediate transfer rollers 22*y*, 22*m*, 22*c*, and 22*b*, are intermediately transferred and overlaid one on another, to a predetermined position of the image bearing surface of the intermediate transfer belt 21, forming a toner image. As will be described hereafter, the toner image is secondarily transferred to the recording paper 8 in a secondary transfer nip region. Toner, paper powder, and the like remaining on the image bearing surface of the intermediate transfer belt 21 after the secondary transfer are removed by the belt cleaner 26, and a toner image is transferred again to the image bearing surface.

Next, a description will be given of the secondary transfer section 4. The secondary transfer section 4 includes a supporting roller 24 and a secondary transfer roller 28, as shown in FIG. 1. The secondary transfer roller 28 is a roller member which comes into pressure-contact with the supporting roller 24 with the intermediate transfer belt 21 interposed therebetween, is provided so as to be able to be rotationally driven about its axis. The secondary transfer roller 28 includes, for example, a metallic shaft body and an electrically conductive layer covering the surface of the metallic shaft body. The metallic shaft body is formed of a metal such as, for example, stainless steel. The electrically conductive layer is formed of an electrically conductive elastic body or the like. As the electrically conductive elastic body, although it is possible to use one commonly used in this field, examples thereof include EPDM, EPDM foam, or urethane foam, which includes an electrically conductive material such as carbon black. A power source (not shown) is connected to the secondary transfer roller 28, and a high voltage with a polarity, the reverse of a toner particle charging polarity, is uniformly applied thereto. A pressure-contact region of the supporting roller 24, intermediate transfer belt 21, and secondary transfer roller 28 are a secondary transfer nip region.

According to the secondary transfer section 4, in synchronism with the toner image on the intermediate transfer belt 21 being conveyed to the secondary transfer nip region, the recording paper 8 fed from the previously described recording material feed section 5 is conveyed to the secondary transfer nip region. Then, by the toner image and the recording paper 8 being overlaid one on the other in the secondary transfer nip region, and the high voltage with the polarity, the reverse of the toner charging polarity, being uniformly applied to the secondary transfer roller 28, an image formed from toner is secondarily transferred to the recording paper 8. Then, the recording paper 8 bearing the toner image is conveyed to the fixing device 6.

Figure 4:
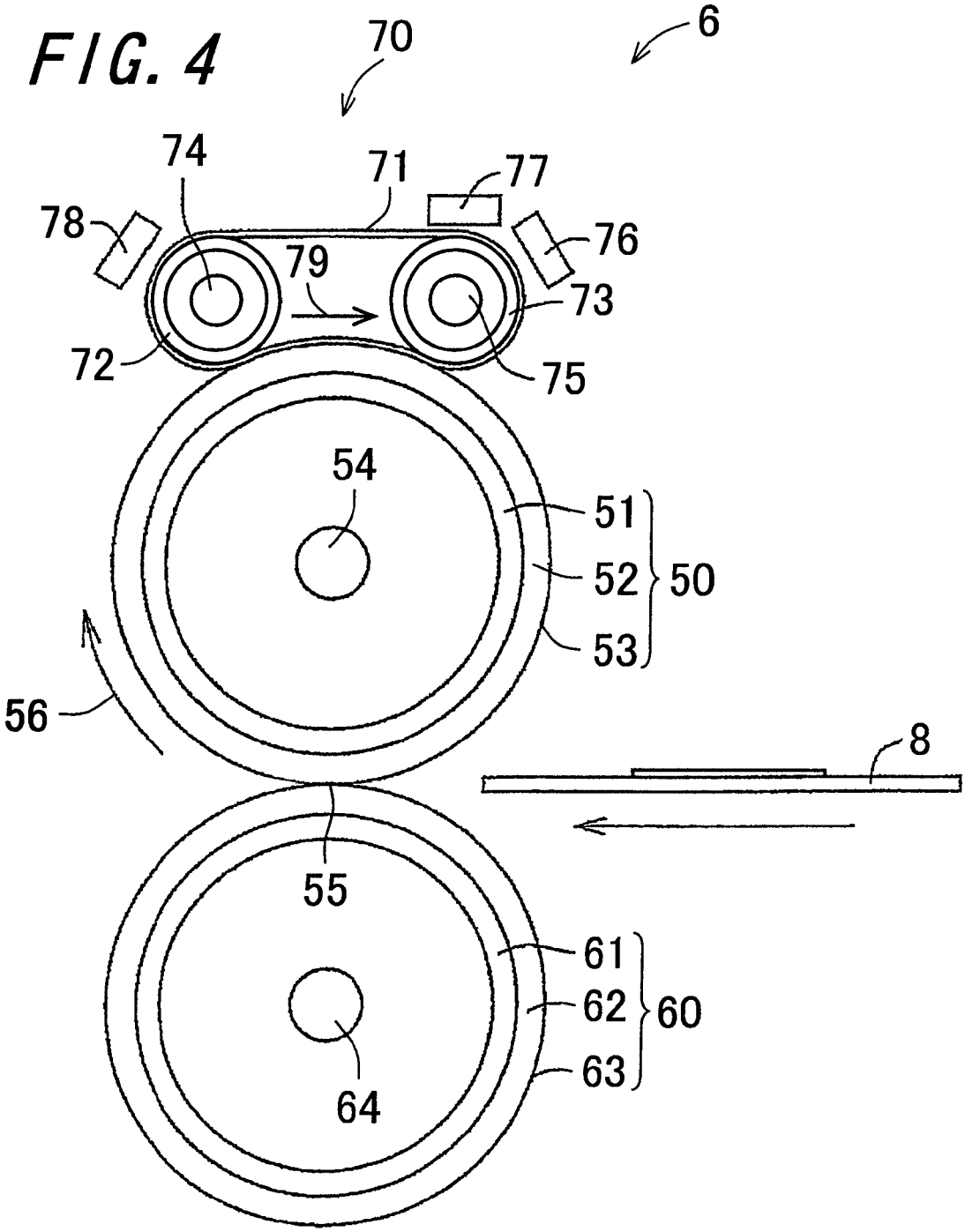
FIG. 4 is a schematic diagram showing a configuration of a fixing device.

Next, a description will be given of the fixing device 6 provided with the feature of the invention. FIG. 4 is a schematic diagram showing a configuration of the fixing device 6. The fixing device 6 includes a heating roller 50 which is a main heating section, a pressure roller 60 which is a pressure section, and an external heating section 70, as shown in FIG. 4.

The heating roller 50 is a roller member which is rotatably supported by a supporting portion (not shown) and which rotates at a predetermined velocity in a direction of an arrow 56 by a driving portion (not shown). The heating roller 50 is used to heat and thus fuse the toner constituting the toner image borne on the recording sheet 8. In the embodiment, as the heating roller 50, a roller member is used which is composed of a metal core 51, an elastic layer 52, and a surface layer 53. A usable metal for forming the metal core 51 is a metal having high thermal conductivity such as aluminum and iron. Shape examples of the metal core 51 include a cylindrical shape, a columnar shape, and the like shape etc., and preferable is the cylindrical shape which discharges a small amount of heat from the metal core 51. For constituting the elastic layer 52, any material having rubber elasticity may be used without particular limitation, and preferably used is a material which is also excellent in heat resistance. Specific examples of such a material include silicone rubber, fluoro-rubber, and fluorosilicone rubber. Among these materials, preferable is the silicone rubber which is particularly excellent in rubber elasticity. For constituting the surface layer 53, any material may be used without particular limitation as long as the material has excellent heat resistance and durability and weak adherence to the toner. Specific examples of the material of the surface layer 53 include a fluorine resin material such as PFA (tetrafluoroethylene-perfluoroalkylvinylether copolymer) and PTFE (polytetrafluoroethylene), and a fluoro-rubber. In the embodiment, the surface layer 53 is an about 40 μm-thick PFA layer. Inside the heating roller 50, a heat source 54 is provided. This is used to shorten a start-up period of time of the image forming apparatus 1 after turning on the power source thereof until a state ready for image formation is set, and prevent a surface temperature of the heating roller 50 from lowering which is caused by heat transfer to the recording sheet 8 in fixing the toner image. In the embodiment, a halogen lamp is used for the heat source 54.

The pressure roller 60 is a roller member which is disposed so as to be rotatable in pressure-contact with the heating roller 50 by a pressurizing mechanism (not shown), in downstream of the lowest point in a vertical direction of the heating roller 50 in a rotational direction of the heating roller 50. A pressure-contact region between the heating roller 50 and the pressure roller 60 is a fixing nip region 55. The pressure roller 60 makes the toner image heated to be fixed onto the recording sheet in cooperation with the heating roller 50. At this time, the pressure roller 60 presses the fused toner against the recording medium 8 to thereby promote the fixing of the toner image onto the recording medium 8. In the embodiment, as the pressure roller 60, a roller member having a diameter of 40 mm is used which is composed of a metal core 61, an elastic layer 62, and a surface layer 63. Usable materials for forming the metal core 61, the elastic layer 62, and the surface layer 63 are respectively the same metal or material which forms the metal core 51, elastic layer 52, and surface layer 53 of the heating roller 50. Further, a shape of the metal core 61 is also the same as that in the case of the heating roller 50. Inside the pressure roller 60, a heat source 64 is provided. This is provided so as to shorten the start-up period of time of the image forming apparatus 1 after turning on the power source thereof until the state ready for image formation is set, and prevent a surface temperature of the fixing roller 60 from drastically lowering which is caused by heat transfer to the recording sheet 8 in fixing the toner image. In the embodiment, a halogen lamp is used for the heat source 64.

The external heating section 70 includes an endless belt 71, and two supporting rollers, which are a first supporting roller 72, and a second supporting roller 73, thermistors 76 and 78 which are temperature detecting members, and the thermostat 77. The endless belt 71 is an endless belt-shaped member which is supported around the first supporting roller 72 and the second supporting roller 73 with tension to thereby form a loop-like travel path. Further, the endless belt 71 is arranged so as to come into contact with the heating roller 50 in a band-shaped region which extends along a longitudinal direction of the fixing roller over a length in an outer circumferential direction of the heating roller 50 from a pressure-contact point between the first supporting roller 72 and the heating roller 50 to a pressure-contact point between the second supporting roller 73 and the heating roller 50. Further, the endless belt 71 is driven to rotate in a direction of an arrow 79 by rotation of the heating roller 50 in the direction of the arrow 56. As the endless belt 71, any belt can be used without particular limitation as long as the belt is excellent in heat-resistance and durability. Examples of materials of the endless belt 71 include a polyimide-made belt and an electroformed nickel belt. A surface of the endless belt 71 may be provided with a fluorine resin layer which is made of PFA, PTFE, or the like material. In the embodiment, a 100 μm-thick endless belt is used which is formed into a cylindrical shape having a diameter of 31 mm.

The first supporting roller 72 and the second supporting roller 73 are roller members which are rotatably supported and disposed so as to come into pressure-contact with a surface of the heating roller 50 with the endless belt 71 interposed therebetween by a pressure mechanism (not shown). The first supporting roller 72 and the second supporting roller 73 are driven to rotate by rotation of the endless belt 71 in the direction of the arrow 79. As the first supporting 72 and the second supporting 73, metallic rollers can be used, each of which is made of a metal having high thermal conductivity such as aluminum and iron. On a surface of the metallic roller, a fluorine resin layer may be formed according to need. The first supporting roller 72 and the second supporting roller 73 contain therein heat sources 74 and 75, respectively. These heat sources heat the endless belt 71 and thus the heating roller 50. The heat sources 74 and 75 are connected to a power source, and electric power is supplied to cause the heat sources 74 and 75 to generate heat. As the heat sources 74 and 75, a commonly-used heat source can be used. In the embodiment, a halogen lamp is used for each of heat sources 74 and 75. Note that the first supporting 72 and the second supporting 73 are disposed so as to have respective axial lines thereof in parallel with each other on the heating roller 50 and so as to be distanced away from each other.

The thermistor 76 is provided so as to be close to the endless belt 71 in a position facing the second supporting roller 73 across the endless belt 71, and detects a second temperature which is the temperature of a portion of the endless belt 71 in which the endless belt 71 is in contact with the second supporting roller 73.

The thermistor 78 is provided so as to be close to the endless belt 71 in a position facing the first supporting roller 72 across the endless belt 71, and detects a second temperature which is the temperature of a portion of the endless belt 71 in which the endless belt 71 is in contact with the first supporting roller 72.

The thermostat 77 is provided so as to be close to the endless belt 71 in a position facing the second supporting roller 73 across the endless belt 71 and downstream of the thermistor 76 in a direction of rotation of the endless belt 71, and detects an abnormal increase in temperature of the endless belt 71.

The above-described fixing device 6 is controlled by the fixing device control circuit 6*a* of the control section 9, as described above. That is, an operation of a fixing mechanism including the heating roller 50, pressure roller 60, and external heating section 70 is controlled by the fixing device control circuit 6*a*.

The CPU 9*a*, on receiving an input of an image formation instruction, sends a control signal to a power source which feeds electric power to heat sources 54, 64, 74, and 75 provided respectively inside the heating roller 50, pressure roller 60, and first and second supporting rollers 72 and 73. The image formation instruction is inputted from external equipment such as the operating section 7*b* provided on the upper surface of the image forming apparatus 1, or a computer connected to the image forming apparatus 1 via a LAN. The power source which has received the control signal feeds electric power, activating the heat sources 54, 64, 74, and 75. The heat sources 54, 64, 74, and 75 heat the heating roller 50, pressure roller 60, and the endless belt 71 so that the surfaces thereof reach their respective setting temperatures.

When a temperature detecting sensor (not shown), which is disposed near the heating roller 50 and the pressure roller 60, detects that temperatures of the above components have reached the set temperatures and such a detected result inputted to the CPU 9*a*, the CPU 9*a* sends a control signal to a driving portion (not shown) for rotating the heating roller 50, thereby driving the heating roller 50 to rotate in the direction of the arrow 56. The driving of the heating section 50 also drives the pressure roller 60 and thus the heating belt 71. In this state, the recording sheet 8 bearing the unfixed toner image is conveyed from the secondary transfer section 4 to the fixing nip region 55. When the recording sheet 8 passes through the fixing nip region 55, the toner constituting the toner image is heated and pressurized to be thereby fixed on the recording sheet 8, resulting in an image.

Next, a description will be given of a warming-up operation of the fixing device 6. The warming-up operation is controlled by the fixing device control circuit 6*a* of the control section 9.

Firstly, the heat sources 74 and 75 of the external heating section 70 provided in the fixing device 6 are powered on. After the endless belt 71 of the external heating section 70 is heated as far as a first temperature T1, a drive motor of the heating roller 50 starts to be rotated. In the event of using the kind of belt type in the embodiment for the external heating section 70, when the endless belt 71 is at a low temperature, the endless belt 71 does not rotate easily due to being impressed by the first and second supporting rollers 72 and 73. For this reason, the drive motor of the heating roller 50 is rotated after the temperature of the endless belt 71 is increased to the temperature T1 at which the belt 71 is sufficiently softened. In order to effectively heat the surface of the heating roller 50, the heat sources 74 and 75 of the external heating section 70 continue to be powered on even after the start of rotation of the drive motor.

After the temperature of the endless belt 71 reaches a temperature T3 (>T1), which is a target temperature, the ON/OFF control of the heat sources 74 and 75 is carried out so as to maintain the belt temperature at T3. When the feed of electric power to the heat sources 74 and 75 of the external heating section 70 is cut off, the feed of electric power is switched to the heat source 54 of the heating roller 50, and the heat source 54 is powered on. By repeating this kind of heating control, the temperature of the heating roller 50 continues to be heated as far as a target temperature T4 (<T3).

The warming-up operation is finished at a point at which the heating roller 50 has reached the target temperature T4. A temperature adjustment is carried out for a target temperature in a standby mode while idling the heating roller 50 for 30 seconds after the finishing of the warming-up operation. By this means, it is possible to diffuse heat accumulated in the heat sources 74 and 75, and the first and second supporting rollers 72 and 73 during the warming-up operation.

An operational mode switches to the standby mode after a lapse of 30 seconds from the finishing of the warming-up operation, stopping the rotation of the drive motor of the heating roller 50. At this time, as the inside of the heating roller 50 is not sufficiently heated, a decrease in temperature of the heating roller 50 occurs.

For this reason, a heating is carried out by feeding electric power to the halogen lamp 54 which is the heat source of the heating roller 50. The feed of electric power to the halogen lamp 54 is stopped at a point at which t1 seconds have elapsed after electric power is fed to the halogen lamp 54, or the surface temperature of the heating roller 50 has reached T5 (<T4).

The feed of electric power to the halogen lamp 54 is maintained in the stopped condition for t2 seconds after the feed of electric power to the halogen lamp 54 is stopped. The surface temperature of the heating roller 50 is detected t2 seconds after the stopping of the feed of electric power to the halogen lamp 54 and, in the event that it is T5 or less, electric power is fed again to the halogen lamp 54.

By this means, as the heating roller 50 ceases to be heated at a point at which the temperature thereof is T5, which is lower than the target temperature T4, it is possible to reduce an overshoot of the surface temperature of the heating roller 50 without a metal core 51 of the heating roller 50 being heated to excess, even when the operational mode is shifted from the warming-up to the standby mode.

It is preferable that the heating is controlled so that the temperature of the metal core 51 is 240° C. or less. In the event of using the previously described kind of material for the elastic body layer 52, by setting the temperature of the metal core 51 to be 240° C. or less, it is possible to prevent a thermal deterioration of the elastic body layer 52.

Figure 5:
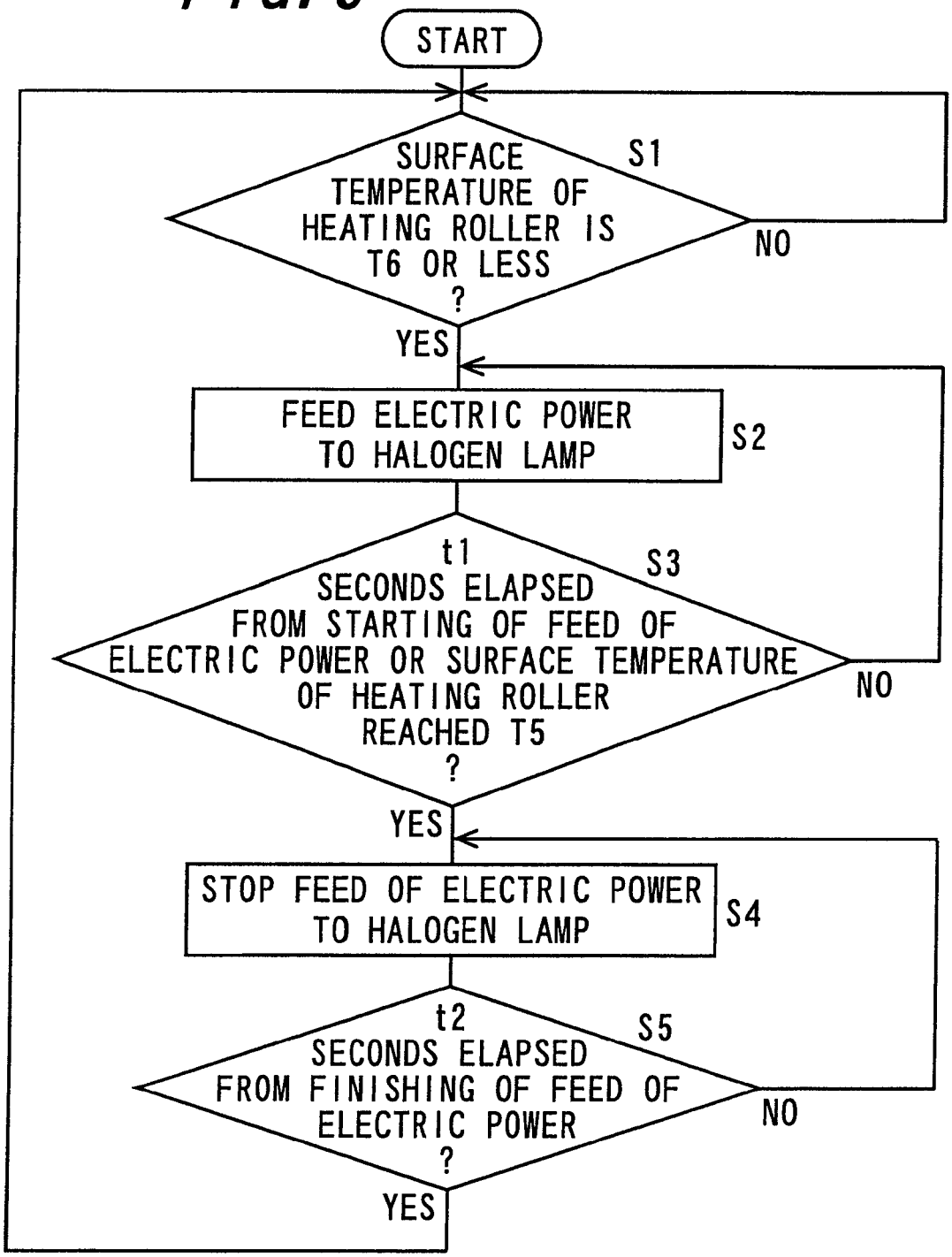
FIG. 5 is a flowchart showing a heating control of the fixing device in a condition in which the temperature thereof is stabilized in the standby mode.
Figure 6:
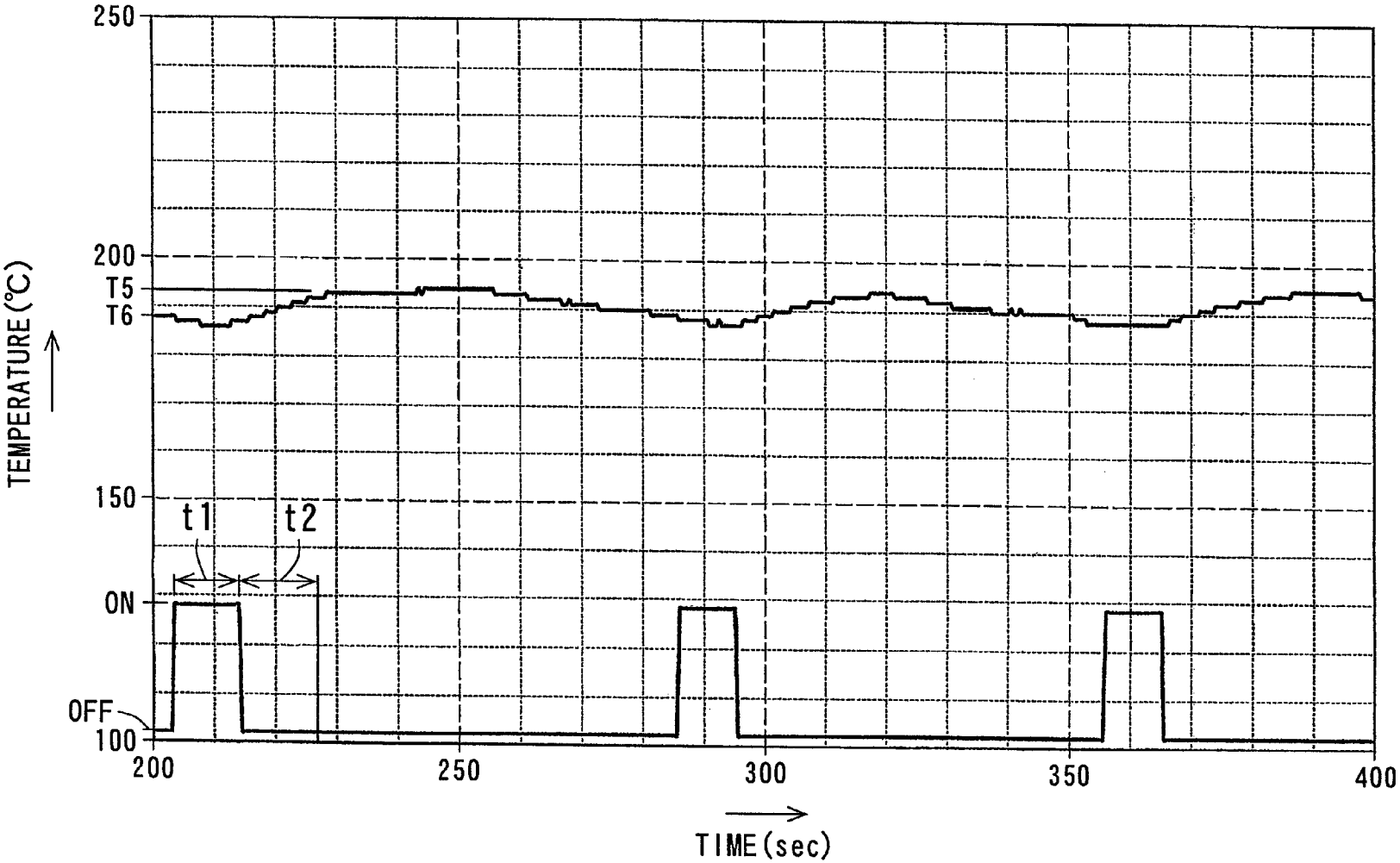
FIG. 6 is a graph showing the surface temperature of a heating roller and an operation timing of a halogen lamp.
Figure 7:
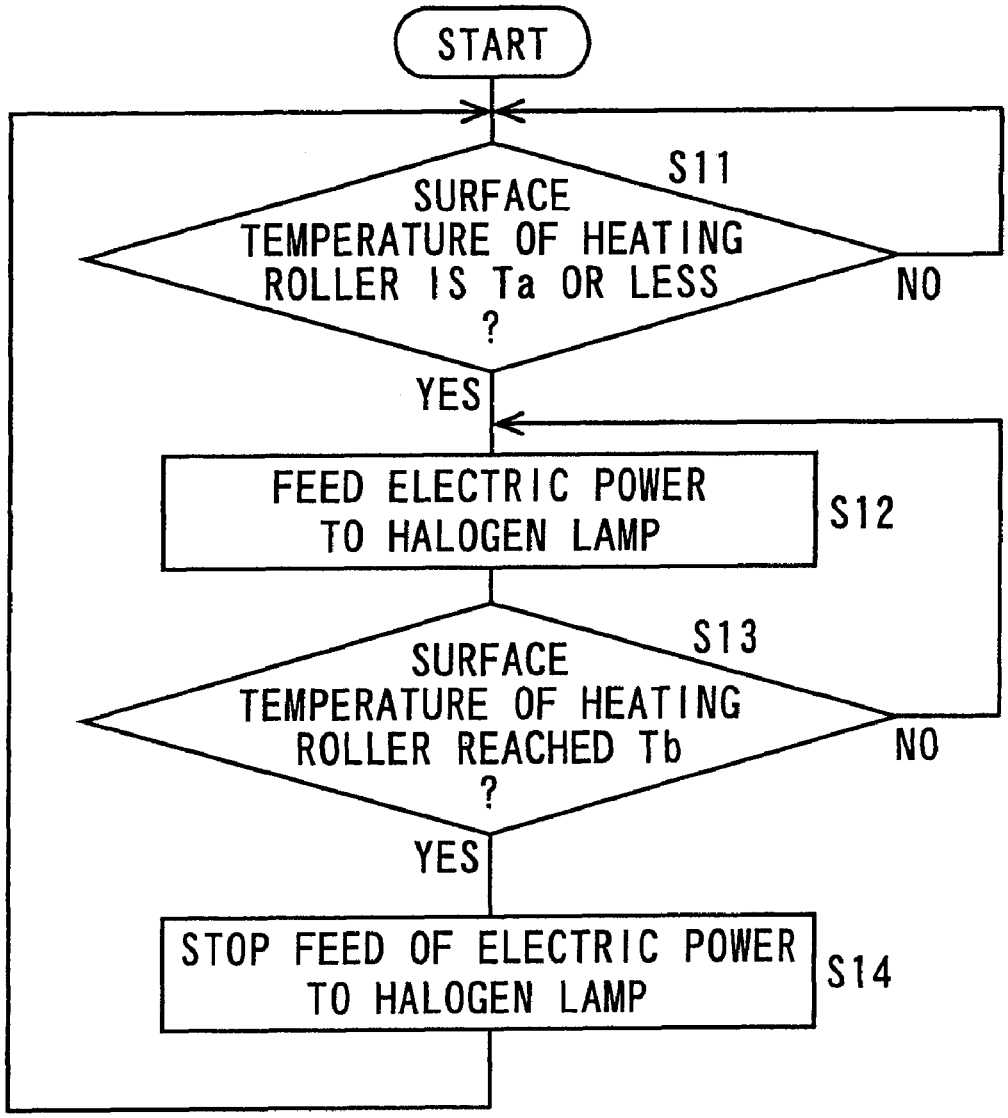
FIG. 7 PRIOR ART
FIG. 7 is a flowchart showing a conventional control method.

FIG. 5 is a flowchart showing a heating control of the fixing device 6 in a condition in which the temperature thereof is stabilized in the standby mode. FIG. 6 is a graph showing the surface temperature of the heating roller 50 and an operation timing of the halogen lamp 54. The horizontal axis indicates time, and the vertical axis indicates the surface temperature of the heating roller 50.

The surface temperature of the heating roller 50 is detected, and it is determined in step S1 whether or not it has decreased to a temperature equal to or less than a temperature T6 (<T5). If it has decreased, the process proceeds to step S2, and if it has not decreased, the process waits. In step S2, electric power is fed to the halogen lamp 54.

In step S3, it is determined whether t1 seconds have elapsed after electric power is fed to the halogen lamp 54, or the surface temperature of the heating roller 50 has reached the temperature T5.

If t1 seconds have elapsed, or the temperature T5 has been reached, the process proceeds to step S4, stopping the feed of electric power to the halogen lamp 54. If t1 seconds have not elapsed, and the temperature T5 has not been reached either, the process returns to step S2, continuing the heating.

It is determined in step S5 whether or not t2 seconds have elapsed after the feed of electric power to the halogen lamp 54 is stopped, and if t2 seconds have elapsed, the process returns to step S1, while if t2 seconds have not elapsed, the feed of electric power continues to be stopped.

By this means, it is possible to reduce the overshoot of the surface temperature of the heating roller 50 without the metal core 51 of the heating roller 50 being heated to excess in the standby mode.

Note that the invention may be realized by means of a program and a recording medium on which the program is recorded.

That is, a heating control CPU (central processing unit) which executes a command of a control program realizing each function, a read only memory (ROM) which stores the program, a random access memory (RAM) which expands the program, a storage device (a recording medium) such as a memory which stores the program and various data, and the like, are included, and a temperature control device is constituted by them. Then, the object of the invention can also be achieved by supplying to the temperature control device the recording medium on which program codes (an execute form program, an intermediate code program, and a source program) of the temperature control program which is the software realizing the above-described functions are recorded so as to be readable by a computer, and retrieving and executing the program codes stored in the recording medium by the computer (or a CPU or MPU).

As the recording medium, it is possible to use, for example, a tape system such as a magnetic tape or cassette tape, a disk system including a magnetic disk such as a floppy (registered trademark) disk or hard disk, or an optical disk such as a CD-ROM, an MO, an MD, a DVD, or a CD-R, a card system such as an IC card (including a memory card) or optical card, or a semiconductor memory system such as a mask ROM, an EPROM, an EEPROM, or a flash ROM.

Also, the temperature control device may be configured so as to be connectable to a communication network, and the program codes may be supplied via the communication network. As the communication network, which is not particularly limited, it is possible to utilize, for example, the Internet, an intranet, an extranet, a LAN, an ISDN, a VAN, a CATV communication network, a virtual private network, a telephone network, a mobile communication network, or a satellite communication network. Also, as a transmission medium constituting the communication network, which is not particularly limited, it is possible to utilize, for example, either a wired line such as an IEEE1394, a USB, a power line carrier, a cable TV line, a telephone line, or an ADSL, or a wireless line such as an infrared ray used in an IrDA or a remote control, Bluetooth (registered trademark), an 802.11 wireless LAN, an HDR, a portable telephone network, a satellite connection, or a digital terrestrial network. The invention can also be realized in the form of a computer data signal embedded in a carrier wave, in which the program codes are embodied by an electronic transmission.

Example 1

Using the above-described fixing device 6, the rotation of the drive motor of the heating roller 50 was stopped 30 seconds after the finishing of the warming-up operation, and the heating control was carried out in the standby mode.

The feed of electric power to the halogen lamp 54 was stopped after a lapse of 9 seconds (t1) from electric power being fed to the halogen lamp 54 of the heating roller 50. The feed of electric power to the halogen lamp 54 was compulsorily stopped for 8 seconds (t2) thereafter. This control was repeatedly carried out until the heating roller reached a target temperature of 200° C.

At this time, the overshoot was 209° C. Also, the maximum temperature of the metal core 51 of the heating roller 50 was 238° C.

Comparative Example 1

Using the above-described fixing device 6, the rotation of the drive motor of the heating roller 50 was stopped 30 seconds after the finishing of the warming-up operation, and the heating control was carried out in the standby mode.

Electric power was fed to the halogen lamp 54 of the heating roller 50, and electric power continued to be fed to the halogen lamp 54 until the surface temperature of the heating roller 50 reached 200° C.

At this time, the overshoot was 217° C. Also, the maximum temperature of the metal core 51 of the heating roller 50 was 253° C.

Example 2

Using the above-described fixing device 6, the heating control was carried out in the condition in which the temperature thereof was stabilized in the standby mode.

Electric power was fed to the halogen lamp 54 of the heating roller 50 at a point at which the surface temperature of the heating roller 50 had reached 188° C. (T6), and the feed of electric power to the halogen lamp 54 was stopped after a lapse of 2 seconds (t1) from the starting of the feed of electric power. The feed of electric power to the halogen lamp 54 was compulsorily stopped for 5 seconds (t2) thereafter. This control was repeatedly carried out until the heating roller reached a target temperature of 190° C.

At this time, a temperature ripple was 13° C., and the overshoot was 200° C. Also, the maximum temperature of the metal core 51 of the heating roller 50 was 227° C.

Example 3

Using the above-described fixing device 6, the heating control was carried out in the condition in which the temperature thereof was stabilized in the standby mode.

Electric power was fed to the halogen lamp 54 of the heating roller 50 at a point at which the surface temperature of the heating roller 50 had reached 188° C. (T6), and the feed of electric power to the halogen lamp 54 was stopped after a lapse of 9 seconds (t1) from the starting of the feed of electric power. The feed of electric power to the halogen lamp 54 was compulsorily stopped for 8 seconds (t2) thereafter. This control is repeatedly carried out until the heating roller reached a target temperature of 190° C.

At this time, the temperature ripple was 8° C., and the overshoot was 194° C. Also, the maximum temperature of the metal core 51 of the heating roller 50 was 224° C.

Example 4

Using the above-described fixing device 6, the heating control was carried out in the condition in which the temperature thereof was stabilized in the standby mode.

Electric power was fed to the halogen lamp 54 of the heating roller 50 at a point at which the surface temperature of the heating roller 50 had reached 188° C. (T6), and the feed of electric power to the halogen lamp 54 was stopped after a lapse of 4 seconds (t1) from the starting of the feed of electric power. The feed of electric power to the halogen lamp 54 was compulsorily stopped for 13 seconds (t2) thereafter.

At this time, the temperature ripple was 7° C., and the overshoot was 193° C. Also, the maximum temperature of the metal core 51 of the heating roller 50 was 213° C.

Comparative Example 2

Using the above-described fixing device 6, the heating control was carried out in the condition in which the temperature thereof was stabilized in the standby mode.

Electric power was fed to the halogen lamp 54 of the heating roller 50 at a point at which the surface temperature of the heating roller 50 had reached 188° C., and electric power continued to be fed to the halogen lamp 54 until the surface temperature of the heating roller 50 reached 190° C. Period of time needed for the electric power feed was 17 seconds.

At this time, the temperature ripple was 17° C., and the overshoot was 203° C. Also, the maximum temperature of the metal core 51 of the heating roller 50 was 235° C.

Comparative Example 3

Using the above-described fixing device 6, the heating control was carried out in the condition in which the temperature thereof was stabilized in the standby mode.

Electric power was fed to the halogen lamp 54 of the heating roller 50 at a point at which the surface temperature of the heating roller 50 had reached 188° C., and the feed of electric power to the halogen lamp 54 was stopped after a lapse of 2 seconds from the starting of the feed of electric power. The feed of electric power to the halogen lamp 54 was compulsorily stopped for 15 seconds thereafter.

At this time, the maximum temperature of the metal core 51 of the heating roller 50 was kept at a low temperature of 210° C., but the heating was not sufficient, and the temperature of the heating roller 50 was 187° C., which was lower than the target temperature.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A fixing device comprising:

a main heating section adapted to be able to rotate around an axis thereof, and heating a recording material bearing an unfixed toner image by a heat source provided therein to fuse toner of the unfixed toner image;

a pressure section disposed so as to form a pressure-contact region between the pressure section and the main heating section by coming into pressure-contact with the main heating section, the pressure section pressing, in cooperation with the main heating section, that recording material bearing the unfixed toner image which is fed at the pressure-contact region, and fixing a toner image on the recording material; and an external heating section disposed so as to come into contact with an outer peripheral surface of the main heating section or pressure section from an exterior thereof, the external heating section heating the main heating section or the pressure section, wherein in a standby mode in which the temperature of the main heating section is held up after the main heating section is heated by a target temperature, heating control is performed, after starting the operation of the heat source, to stop the operation of the heat source when the operation period of time of the heat source reaches a predetermined fixed period of time.

2. The fixing device of claim 1, wherein, in an operational mode other than the standby mode, the heating control is not carried out.

3. The fixing device of claim 1, wherein the heating section is formed with a roller member comprising a metal core, an elastic body layer, and a surface layer, and in the heating control, the operation of the heat source is controlled so that the temperature of the metal core is 240° C. or less.

4. An image forming apparatus provided with the fixing device of claim 1.

5. A computer readable recording medium on which is recorded a temperature control program for causing a computer to perform the heating control in the fixing device of claim 1.

6. The fixing device of claim 1, wherein, in the standby mode, the heating control is performed to stop the operation of the heat source when the temperature of the surface of the main heating section reaches a first temperature lower than the target temperature.

7. A fixing device comprising:

a main heating section adapted to be able to rotate around an axis thereof, and heating a recording material bearing an unfixed toner image by a heat source provided therein to fuse toner of the unfixed toner image;

a pressure section disposed so as to form a pressure-contact region between the pressure section and the main heating section by coming into pressure-contact with the main heating section, the pressure section pressing, in cooperation with the main heating section, that recording material bearing the unfixed toner image which is fed at the pressure-contact region, and fixing a toner image on the recording material; and an external heating section disposed so as to come into contact with an outer peripheral surface of the main heating section or pressure section from an exterior thereof, the external heating section heating the main heating section or the pressure section, wherein in a standby mode in which the temperature of the main heating section is held up after the main heating section is heated by a target temperature, heating control is performed, after starting the operation of the heat source, to stop the operation of the heat source when the operation period of time of the heat source reaches a predetermined fixed period of time, and continue to do so for a given length of time.

8. The fixing device of claim 7, wherein, in an operational mode other than the standby mode, the heating control is not carried out.

9. The fixing device of claim 7, wherein the heating section is formed with a roller member comprising a metal core, an elastic body layer, and a surface layer, and in the heating control, the operation of the heat source is controlled so that the temperature of the metal core is 240° C. or less.

10. An image forming apparatus provided with the fixing device of claim 7.

11. A computer readable recording medium on which is recorded a temperature control program for causing a computer to perform the heating control in the fixing device of claim 7.

12. The fixing device of claim 7, wherein, in the standby mode, the heating control is performed to stop the operation of the heat source when the temperature of the surface of the main heating section reaches a first temperature lower than the target temperature, and continue to do so for a given length of time.

* * * * *